US012622558B2

(12) United States Patent
Duan et al.

(10) Patent No.: US 12,622,558 B2
(45) Date of Patent: May 12, 2026

(54) BRUSH, BRUSH MEMBER AND ROBOT

(71) Applicant: Beijing Roborock Technology Co., Ltd., Beijing (CN)

(72) Inventors: Chuanlin Duan, Beijing (CN); Erdong Gu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 501 days.

(21) Appl. No.: 17/383,535

(22) Filed: Jul. 23, 2021

(65) Prior Publication Data

US 2021/0345850 A1 Nov. 11, 2021

Related U.S. Application Data

(63) Continuation of application No. PCT/CN2020/072630, filed on Jan. 17, 2020.

(30) Foreign Application Priority Data

Jan. 24, 2019 (CN) ..... 201920126884.3

(51) Int. Cl.
*A47L 11/282* (2006.01)
*A47L 11/40* (2006.01)

(52) U.S. Cl.
CPC ..... *A47L 11/282* (2013.01); *A47L 11/4041* (2013.01); *A47L 11/4069* (2013.01); *A47L 2201/00* (2013.01)

(58) Field of Classification Search
CPC ..... A47L 11/4036; A47L 11/4041; A47L 11/4069; A47L 11/18; A47L 11/19;
(Continued)

(56) References Cited

U.S. PATENT DOCUMENTS 4,209,872 A * 7/1980 Maier ..... A47L 5/30 384/220
4,429,430 A * 2/1984 Lyman ..... A47L 9/0444 15/366

(Continued)

FOREIGN PATENT DOCUMENTS

CN 204120958 U 1/2015
CN 204618100 U 9/2015

(Continued)

OTHER PUBLICATIONS

Translation of JP 2596223 Y2, corresponding to JPH0631642U cited in the IDS IDS filed Dec. 27, 2022. (Year: 1999).*

(Continued)

*Primary Examiner* — David S Posigian
*Assistant Examiner* — Steven Huang
(74) *Attorney, Agent, or Firm* — Morgan, Lewis & Bockius LLP

(57) ABSTRACT

The present application relates to a brush, a brush member, and a robot. The brush includes a brush body (1), including: a rotating shaft (11) having a first end portion (13) and a second end portion (14); a compliant portion (12) extending radially outward from the rotating shaft; a first detachable baffle (2), which is detachably mounted on the first end portion (13); and a second detachable baffle (3), which is detachably mounted on the second end portion (14), wherein the first end portion is provided with a foolproof structure for preventing missing mounting of the first detachable baffle.

16 Claims, 5 Drawing Sheets

(58) Field of Classification Search
CPC ..... A47L 11/282; A47L 11/24; A47L 11/32; A47L 11/40; A47L 2201/00; A47L 5/30; A47L 9/0477; A47L 9/0427; A47L 9/0455; Y10T 403/602; Y10T 403/604; F16B 21/10
See application file for complete search history.

(56) References Cited

U.S. PATENT DOCUMENTS

| | | | | | |
|---|---|---|---|---|---|
| 4,912,805 | A * | 4/1990 | Krasznai | A47L 9/0477 | 15/207.2 |
| 5,465,451 | A * | 11/1995 | Stegens | A46B 13/001 | 492/29 |
| 6,324,714 | B1 * | 12/2001 | Walz | A47L 11/22 | 15/52.1 |
| 8,402,601 | B2 * | 3/2013 | Fahlstrom | A47L 9/0477 | 15/389 |
| 2008/0052846 | A1 * | 3/2008 | Kapoor | A47L 9/19 | 15/52.1 |
| 2012/0201597 | A1 * | 8/2012 | Comerford | E04C 5/18 | 403/306 |
| 2012/0204367 | A1 * | 8/2012 | Stegens | A47L 9/0427 | 15/88.4 |
| 2013/0232702 | A1 * | 9/2013 | Baek | A47L 9/0477 | 15/88.4 |
| 2015/0300415 | A1 * | 10/2015 | Russell | F16D 1/108 | 403/306 |
| 2015/0335220 | A1 | 11/2015 | Kim et al. | | |
| 2016/0138631 | A1 * | 5/2016 | Kresge | F16D 1/112 | 403/376 |
| 2016/0348730 | A1 * | 12/2016 | Newth | F16D 1/108 | |

FOREIGN PATENT DOCUMENTS

| | | | | |
|---|---|---|---|---|
| CN | 205234411 | U | 5/2016 | |
| CN | 205970630 | U | 2/2017 | |
| EP | 3231342 | A1 | 10/2017 | |
| GB | 1109783 | A * | 6/1965 | |
| JP | H06-031642 | U | 4/1994 | |
| JP | H0998916 | A * | 4/1997 | |
| JP | 2003052585 | A * | 2/2003 | |
| JP | 105982623 | A | 10/2016 | |
| WO | WO-2011103198 | A1 * | 8/2011 | A47L 11/40 |
| WO | 2018/152999 | A1 | 8/2018 | |

OTHER PUBLICATIONS

Translation of JP 2003052585 A (Year: 2003).*
Translation of JP H0998916 A (Year: 1997).*
Extended European Search Report issued in counterpart European Patent Application No. 20745484.4 dated Sep. 29, 2022.
International Search Report issued in related International Patent Application No. PCT/CN2020//072630 dated Apr. 15. 2020.

* cited by examiner

BRUSH, BRUSH MEMBER AND ROBOT

CROSS-REFERENCE TO RELATED APPLICATIONS

The present application is a continuation application of International Application No. PCT/CN2020/072630, filed on Jan. 17, 2020, which claims priority to Chinese Patent Application No. 2019201268843, filed with the Chinese Patent Office on Jan. 24, 2019, titled "ROBOT-SPECIFIC BRUSH, MEMBER AND ROBOT," both of which are incorporated herein by reference in their entireties for all purposes.

TECHNICAL FIELD

The present application pertains to the field of robot technologies, and, in particular, to a brush, a brush member, and a cleaning robot.

BACKGROUND

During operation of a cleaning robot, a main brush disposed on the bottom of the cleaning robot rotates to agitate the debris on the floor surface. However, the main brush is easily entangled with filaments, increasing the load of the driving motor or even causing failure of the driving motor to drive.

SUMMARY

According to a first aspect of the present application, a brush is provided. The brush is applied to a cleaning robot and may include a brush body, including a rotating shaft and a compliant portion, wherein the rotating shaft has a first end portion and a second end portion and the compliant portion extends radially outward from the rotating shaft; a first detachable baffle detachably mounted to the first end portion; and a second detachable baffle detachably mounted to the second end portion, wherein the first end portion is provided with a foolproof structure for preventing missing mounting of the first detachable baffle.

According to a second aspect of the present application, a brush member is provided. The brush member is applied to a cleaning robot and includes a member housing and a brush. The brush may include a brush body, including a rotating shaft and a compliant portion, wherein the rotating shaft has a first end portion and a second end portion and the compliant portion extends radially outward from the rotating shaft; a first detachable baffle detachably mounted to the first end portion; and a second detachable baffle detachably mounted to the second end portion, wherein the first end portion is provided with a foolproof structure for preventing missing mounting of the first detachable baffle to the member housing.

According to a third aspect of the present application, a cleaning robot is provided. The cleaning robot may include a brush member having a member housing and a brush. The brush may include a brush body, including a rotating shaft and a compliant portion, wherein the rotating shaft has a first end portion and a second end portion and the compliant portion extends radially outward from the rotating shaft; a first detachable baffle detachably mounted to the first end portion; and a second detachable baffle detachably mounted to the second end portion, wherein the first end portion is provided with a foolproof structure for preventing missing mounting of the first detachable baffle to the member housing.

BRIEF DESCRIPTION OF DRAWINGS

To describe the technical solutions in the embodiments of the present application more clearly, the following briefly introduces the accompanying drawings for describing the embodiments. Clearly, the accompanying drawings in the following description show merely some embodiments of the present application, and those skilled in the art may still derive other drawings from these accompanying drawings without creative efforts.

DESCRIPTION OF EMBODIMENTS

Figure 1:
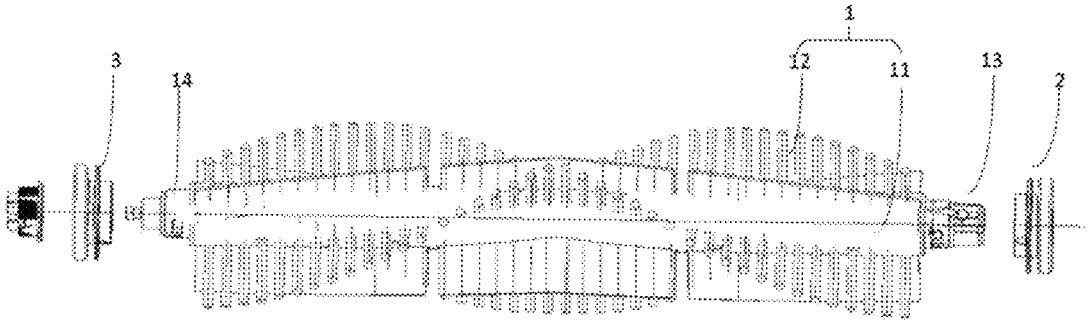
FIG. 1 is an overall schematic structural diagram of a brush according to an embodiment of the present application.

The following further describes embodiments of the present application in detail with reference to accompanying drawings. Clearly, the described embodiments are merely some rather than all of the embodiments of the present application. All other embodiments obtained by those skilled in the art based on the embodiments of the present application without creative efforts shall fall within the protection scope of the present application.

The terms used in the embodiments of the present application are merely for the purpose of illustrating specific embodiments, and are not intended to limit the present application. The terms "a," "the," and "this" of singular forms used in the embodiments and the appended claims of the present application are also intended to include plural forms, unless otherwise specified in the context clearly. "A plurality of" generally includes at least two.

It should be understood that the term "and/or" in this specification describes only an association relationship for describing associated objects and represents that three relationships may exist. For example, A and/or B may represent the following three cases: Only A exists, both A and B exist, and only B exists. In addition, the character "/" in this specification generally indicates an "or" relationship between associated objects.

It should be understood that, although terms such as "first", "second", and "third" may be used in embodiments of the present application to describe components, the components should not be limited by these terms. These terms are merely used to distinguish between similar objects. For example, without departing from the scope of the embodiments of the present application, a first component may also be referred to as a second component, and similarly, the second component may also be referred to as the first component.

Depending on the context, for example, the word "if" used herein may be explained as "while" or "when" or "in response to determining" or "in response to detection." Similarly, depending on the context, the phrases "if determining" or "if detecting (a stated condition or event)" may be explained as "when determining" or "in response to determining" or "when detecting (the stated condition or event)" or "in response to detecting (the stated condition or event)."

It should further be noted that the terms "include," "comprise," or any other variant thereof are intended to cover a non-exclusive inclusion, so that a product or a system that includes a list of elements not only includes those elements but also includes other elements that are not expressly listed, or further includes elements inherent to such a product or system. An element preceded by "includes a . . . " does not, without more constraints, preclude the existence of additional identical elements in the product or system that includes the element.

The following describes in detail some example embodiments of the present application with reference to the accompanying drawings.

Embodiment 1

Figure 2:
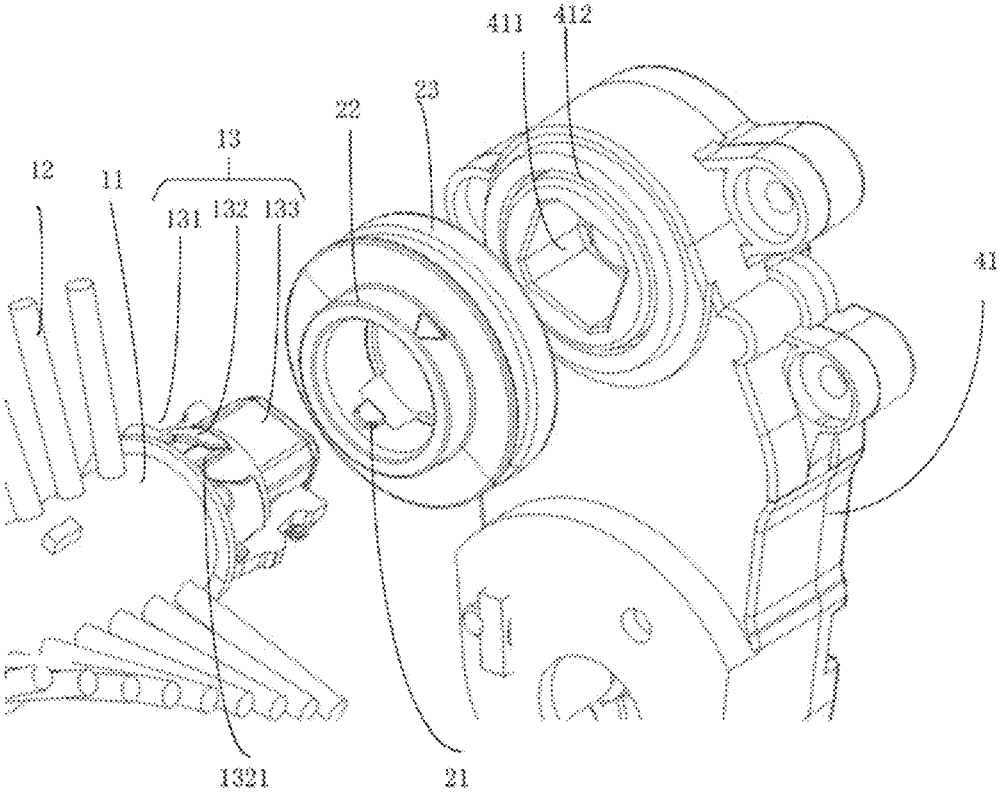
FIG. 2 is a schematic structural diagram of a first end of a brush and a side wall in a separated state according to an embodiment of the present application.
Figure 6:
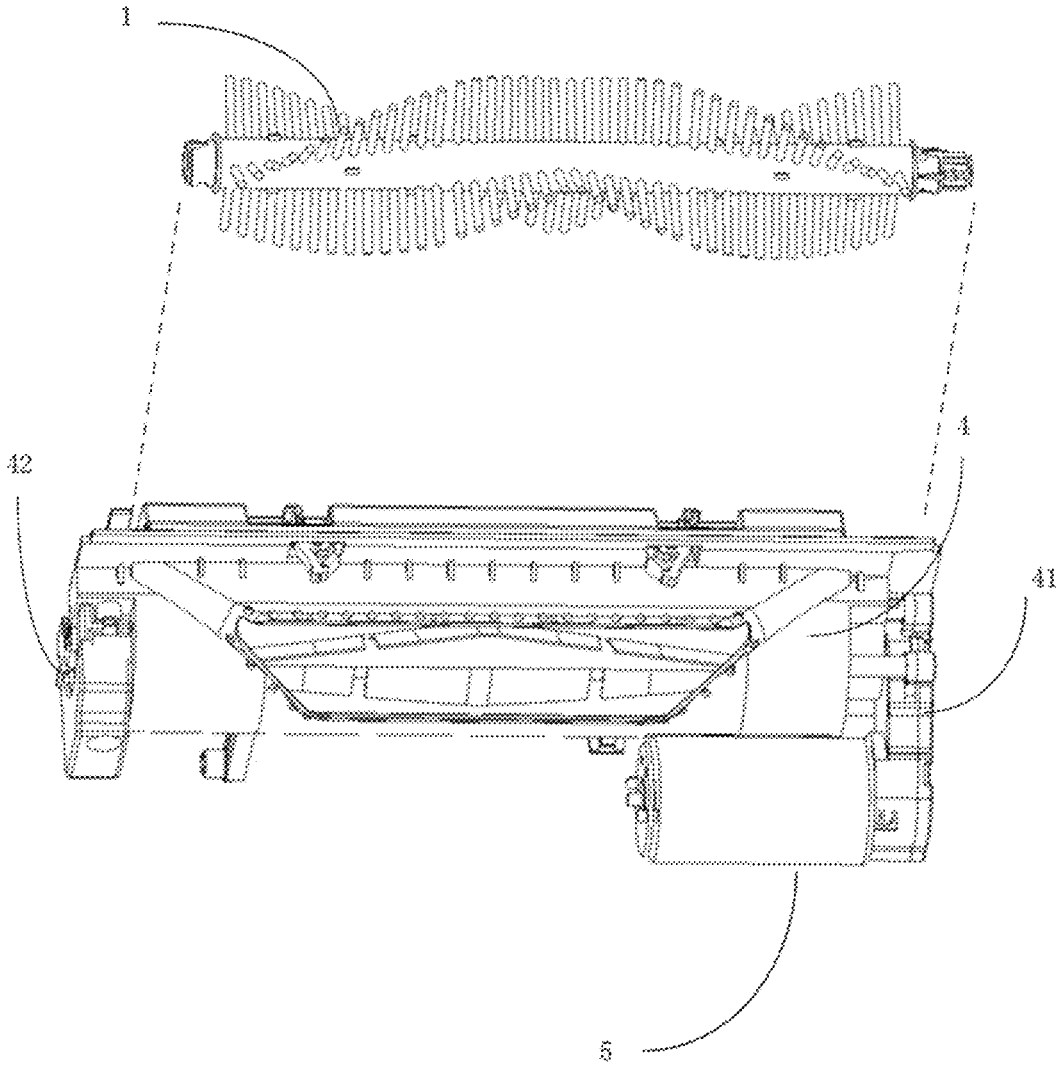
FIG. 6 is an overall schematic structural diagram of a brush member according to an embodiment of the present application.

As shown in FIG. 1 and FIG. 2, an embodiment of the present application provides a brush, and the brush may be applied to a cleaning robot. The brush includes a brush body 1 including a rotating shaft 11. The rotating shaft 11 is connected to a motor 5 (as shown in FIG. 6) and rotates around a rotating axis under driving of the motor. The rotating shaft 11 may have a hollow or solid structure. The brush body 1 further includes a compliant portion, i.e., bristles 12 extending radially outward from the rotating shaft. The bristles are distributed around the rotating shaft 11 regularly. For example, a structure of 3-5 rows of bristles parallel to the rotating shaft or a wavy structure of 3-5 rows of bristles may be employed. The number of rows of bristles can be reasonably designed based on the size of the rotating shaft and is not limited separately herein. The bristles may be made of plastic or other polymer materials. A flapper, i.e., a soft rubber scraping strip, may be arranged between rows of the bristles. The scraping strip can increase negative pressure of a dust suction duct during operation of a cleaning robot, thereby improving dust pick-up (DPU) efficiency of the cleaning robot. The brush body 1 further includes a first end portion 13 and a second end portion 14, and the first end portion 13 and the second end portion 14 are respectively located at two ends of the rotating shaft 11. The brush further includes two detachable baffles: a first detachable baffle 2 detachably mounted on the first end portion 13; a second detachable baffle 3 detachably mounted on the second end portion 14. The first end portion 13 may be further provided with a foolproof structure 131 (as shown in FIG. 2) for preventing missing mounting of the first detachable baffle 2. In the embodiments of the present application, the two detachable baffles may have the same structure, and may be round, or may be square or other shapes, as shown in FIG. 1 or FIG. 2.

Figure 3:
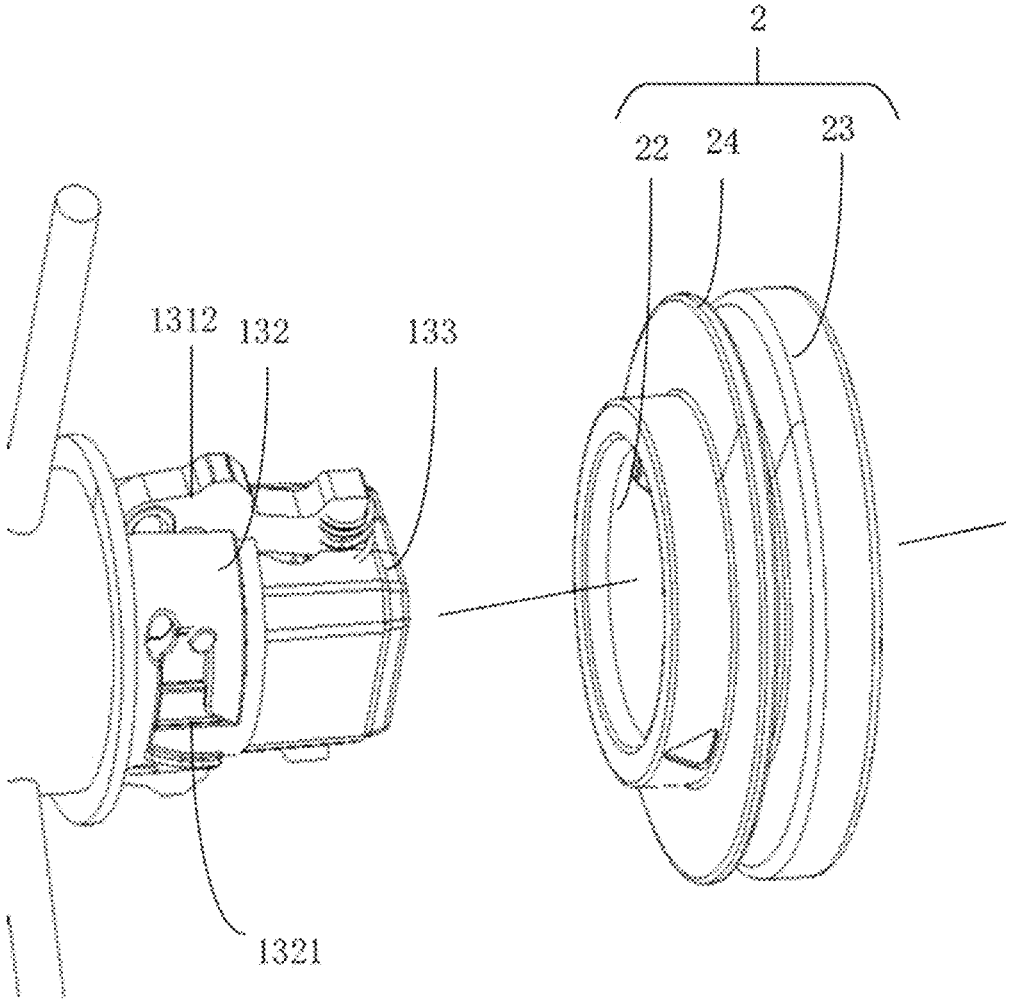
FIG. 3 is a schematic structural diagram of a first end of a brush in a separated state according to an embodiment of the present application.

Optionally, as shown in FIG. 2 or FIG. 3, in some embodiments, the first end portion 13 may connect the motor for rotating the brush and include a first mounting portion 132 and a second mounting portion 133. The first mounting portion 132 may generally have a cylindrical structure with a diameter slightly smaller than a diameter of the rotating shaft 11 and may be formed through extension along the rotating shaft 11. The second mounting portion 133 extends outward along the first mounting portion 132 and forms a step with the first mounting portion 132. The second mounting portion 133 optionally has a square structure with the side length smaller than the diameter of the first mounting portion 132. That is, two steps are formed outward from the rotating shaft. The first mounting portion 132 is configured to match the shape of the first detachable baffle 2, and the second mounting portion 133 is configured to match a structure of a first side wall 41 of a member housing 4 (as shown in FIG. 6). The first end portion of the rotating shaft can be properly mounted to the member housing 4 when the shapes and sizes match.

Figure 4:
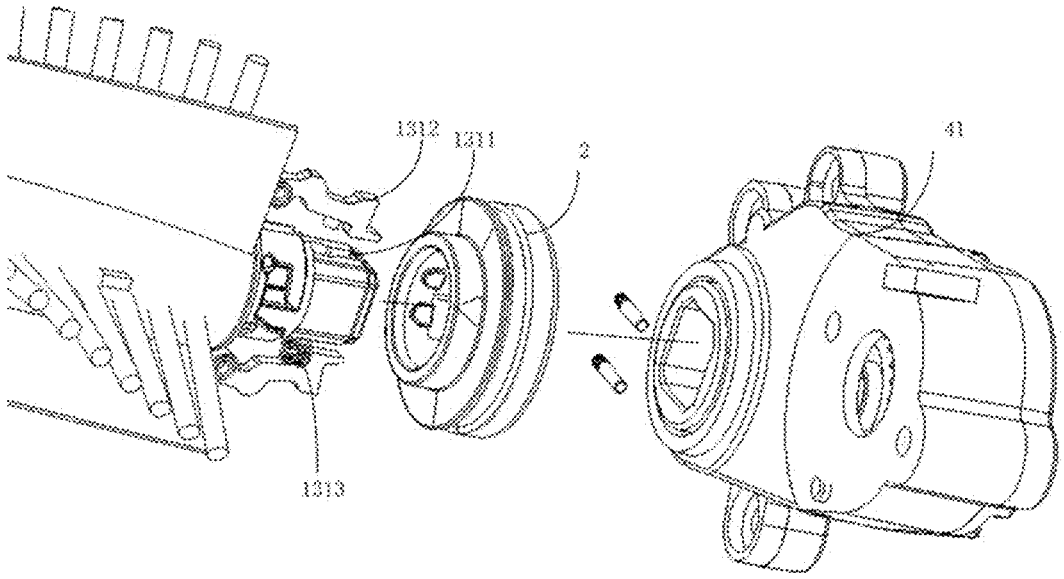
FIG. 4 is a schematic structural diagram of a first end of a brush and a side wall in a separated state from another perspective according to an embodiment of the present application.

Optionally, as shown in FIG. 2 or FIG. 3 or FIG. 4, in some embodiments, the foolproof structure 131 may include a groove 1311, which may be disposed on the first mounting portion 132 and the second mounting portion 133 along the rotating axis. The foolproof structure 131 further includes at least one clamping part 1312, which is displaceably mounted in the groove 1311. In some embodiments, there may be two clamping parts 1312 disposed opposite to each other. The foolproof structure 131 further includes an elastic element 1313, which is connected to the clamping part 1312 to make the clamping part 1312 retract into or extend out of the groove 1311. The elastic element 1313 may be a helical spring or an elastic sheet, etc.

Optionally, in some embodiments (not shown), the groove 1311 does not penetrate the first mounting portion 132 and the second mounting portion 133. That is, the groove 1311 is a structure similar to a blind hole in the first mounting portion 132 and the second mounting portion 133. In this case, there is one clamping part 1312. One end of the elastic element 1313 is connected to the clamping part 1312, and the other end of the elastic element 1313 abuts against the bottom of the groove 1311. In this embodiment, the clamping part 1312 achieves elastic stretching and retraction in the groove 1311.

Optionally, in an embodiment, as shown in FIG. 3 and FIG. 4, the groove 1311 is a through hole penetrating the first mounting portion 132 and the second mounting portion 133; there are two clamping parts 1312, which are symmetrically arranged on both ends of the groove 1311; one elastic element 1313 disposed in the groove 1311 connects the two clamping parts 1312, to make the two clamping parts 1312 retract into or stretch out of the groove 1311.

Optionally, in some embodiments, as shown in FIG. 3 and FIG. 4, the clamping part 1312 includes at least one first protrusion, which is located at the second mounting portion 133, configured to abut against the inner side of the first detachable baffle 2. In other embodiments, there may be at least two protrusions to abut against the inner side of the first detachable baffle 2. The clamping part 1312 further includes a second protrusion, which is arranged on the same side as the first protrusion (as shown in FIG. 3 and), located at the first mounting portion 132. When the first detachable baffle 2 is mounted on the brush, the inner side of the first detachable baffle 2 presses the second protrusion to make the clamping part 1312 retract. In this case, the first protrusion of the clamping part 1312 retracts into the groove 1311, which ensures that the second mounting portion 133 can match the first side wall 41 of the member housing 4 (as shown in FIG. 6). On the contrary, when the first detachable baffle 2 is not mounted on the brush, the clamping part 1312 is in the extending state, and the second protrusion extends out of the groove 1311, which prevents the brush mounting on the member housing 4.

The clamping part 1312 may further include at least one third protrusion, which is arranged on the inner side of the clamping part 1312 and is configured to connect to the elastic element 1313.

Optionally, in some embodiments, as shown in FIG. 3, the first mounting portion 132 further includes at least one first locking portion 1321; the inner side of the first detachable baffle 2 includes at least one first locking block 21 (as shown in FIG. 2) corresponding to the first locking portion 1321. When the first detachable baffle 2 is mounted on the first end portion 13 (as shown in FIG. 1), the first locking block 21 slides into the first locking portion 1321 to achieve locking. Optionally, the first locking portion 1321 may have an L-shaped sliding groove structure. When entering the first locking portion 1321 from an entrance of the L-shaped sliding groove, the first locking block 21 rotates at a specific angle in a circumferential direction of the first mounting portion 132, so that the first locking block 21 slides into a lateral position of the L-shaped sliding groove to achieve locking.

Optionally, in other embodiments, the first locking portion 1321 may alternatively have a spherical recess structure, and the first locking block 21 has a hemispherical protrusion structure. When the first detachable baffle 2 is axially mounted to the first mounting portion 132, the hemispherical first locking block 21 slides into the spherical recess in the axial direction to achieve locking.

Optionally, in some embodiments, as shown in FIG. 3 or FIG. 4, the first detachable baffle 2 includes a first aperture 22, an inner diameter of which matches an outer diameter of the first mounting portion 132, and an axial size of which matches an axial size of the first mounting portion 132. The first detachable baffle 2 is mounted to the first mounting portion 132 by the first mounting portion 132 extending into the first aperture 22. The first detachable baffle 2 further includes a first baffle portion, which extends outward in the circumferential direction of the first aperture 22. In some embodiments, the first baffle portion may include a first guard 23 and a second guard 24, which may be disposed parallel to each other. In this case, the first guard 23 and the second guard 24 form a maze to prevent the filaments from traversing axially beyond the extremity of the first end portion 13 (as shown in FIG. 1) and entering the motor.

Figure 5:
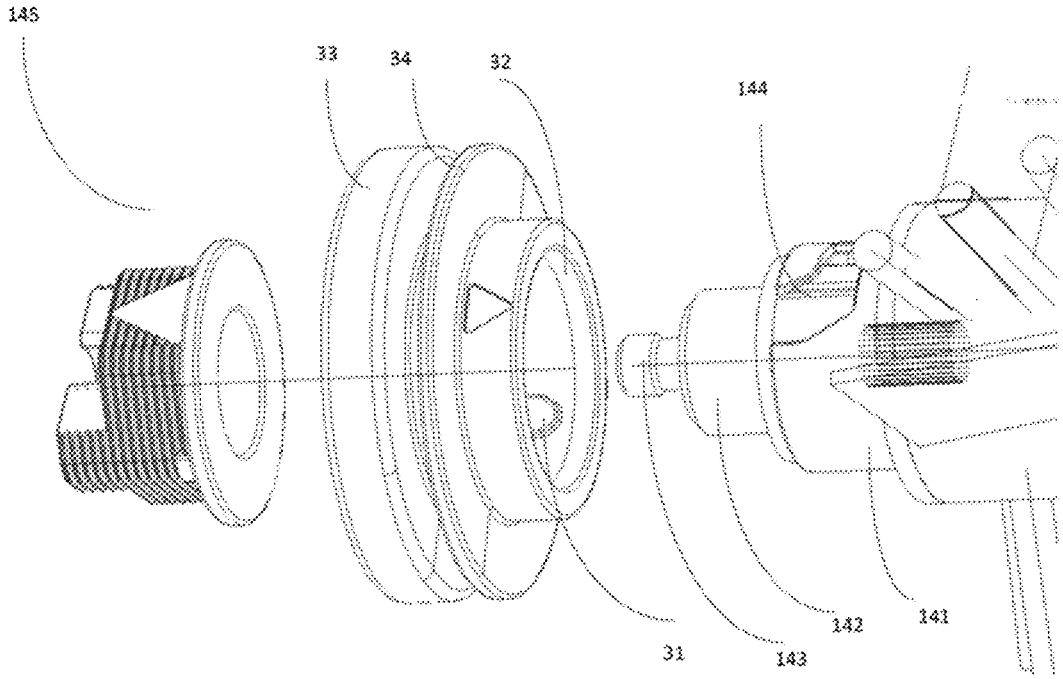
FIG. 5 is a schematic structural diagram of a second end of a brush in a separated state according to an embodiment of the present application.

Optionally, as shown in FIG. 5, in some embodiments, the second end portion 14 (as shown in FIG. 1) may include a third mounting portion 141 and a fourth mounting portion 142. The third mounting portion 141 may generally have a cylindrical structure with a diameter slightly smaller than a diameter of the rotating shaft 11 (as shown in FIG. 1) and may be formed through extension along the rotating shaft 11. The fourth mounting portion 142 extends outward along the third mounting portion 141 and forms a step with the third mounting portion 141. The fourth mounting portion 142 optionally has a round structure with a diameter smaller than the diameter of the third mounting portion 141, that is, a continuous step portion is formed outward from the rotating shaft. The third mounting portion 141 is configured to match the shape of the second detachable baffle 3 (as shown in FIG. 1), and the fourth mounting portion 142 is configured to match a structure of a joint 145. The second end portion of the rotating shaft can be properly mounted to the member housing 4 (as shown in FIG. 6) when the shapes and sizes match. The second end portion 14 (as shown in FIG. 1) may include a shaft portion 143 for extending into the joint 145 and then rotating.

Optionally, in some embodiments, as shown in FIG. 5, the third mounting portion 141 further includes at least one second locking portion 144; the inner side of the second detachable baffle 3) as shown in FIG. 1) includes at least one second locking block 31 corresponding to the second locking portion 144, and when the second detachable baffle 3 is mounted on the second end portion 14 (as shown in FIG. 1), the second locking block 31 slides into the second locking portion 144 to achieve locking. Optionally, the second locking portion 144 may have an L-shaped sliding groove structure. After entering the second locking portion 144 from an entrance to the L-shaped sliding groove, the second locking block 31 rotates at a specific angle in a circumferential direction of the third mounting portion 141, so that the second locking block 31 slides into a lateral position of the L-shaped sliding groove to achieve locking.

Optionally, in other embodiments, the second locking portion 144 may alternatively have a spherical recess structure, and the second locking block 31 has a hemispherical protrusion structure. When the second detachable baffle 3 is axially mounted to the third mounting portion 141, the hemispherical second locking block 31 slides into the spherical recess in the axial direction to achieve locking.

Optionally, in some embodiments, as shown in FIG. 5, the second detachable baffle 3 (as shown in FIG. 1) includes a third aperture 32, an inner diameter of which matches an outer diameter of the third mounting portion 141, and an axial size of which matches an axial size of the third mounting portion 141. The second detachable baffle 3 is mounted to the third mounting portion 141 by the third mounting portion 141 extending into the third aperture 32. The second detachable baffle 3 further includes a second baffle portion, which extends outward in the circumferential direction of the third aperture 32. In some embodiments, the second baffle portion may include a third guard 33 and a fourth guard 34, which may be disposed parallel to each other. In this case, the third guard 33 and the fourth guard 34 form a maze to prevent the filaments from traversing axially beyond the extremity of the first end portion 14 (as shown in FIG. 1).

Optionally, in some embodiments, as shown in FIG. 5, a joint 145 is further included, which may have a threaded structure and is configured to be fixed to the second side wall 42 (as shown in FIG. 6) in a threaded manner. When the first end portion 13 and the second end portion 14 (as shown in FIG. 1) are respectively mounted on the first side wall 41 and the second side wall 42 (as shown in FIG. 6), the mounting of the brush body is completed.

According to the brush provided in the embodiments of the present application, addition of a detachable baffle can effectively prevent filaments on the brush of the cleaning robot from entering the motor, and the design of the foolproof structure can effectively prevent a user from missing the detachable baffle, and further prevent filaments and other objects from entering the driving motor of the main brush, thereby preventing damage to the motor.

Embodiment 2

An embodiment of the present application provides a brush member (as shown in FIG.6), including a member housing 4 and the brush described in Embodiment 1. The structure of the brush has been described above, and details are not described herein again.

Optionally, in some embodiments, as shown in FIG. 2 or FIG. 4, the member housing 4 (as shown in FIG. 6) includes a first side wall 41 for connecting to the first end portion 13 (as shown in FIG. 1), and the first side wall 41 includes a first accommodation hole 411 for accommodating the second mounting portion 133 of the first end portion 13. The first accommodation hole 411 may be a square blind hole with a depth slightly greater than an axial length of the second mounting portion 133. The first side wall 41 may further include a first annular groove 412, which is arranged around the first accommodation hole 411, and is configured to accommodate a side wall of the second aperture 23 of the first detachable baffle 2. The depth of the first annular groove 412 may be sufficient to accommodate the side wall of the second aperture 23.

The member housing 4 further includes a second side wall 42, which is configured to connect to the second end portion 14. The second side wall 42 may include an internally threaded hole, which is configured to be fixed and connected to the threaded joint 145.

According to the brush member provided in the embodiments of the present application, the detachable baffle can effectively prevent filaments on the brush of the cleaning robot from entering the motor, and the design of the foolproof structure can effectively prevent a user from missing the detachable baffle, and further prevent filaments and other objects from entering the driving motor of the main brush, thereby preventing damage to the motor.

Embodiment 3

Figure 7:
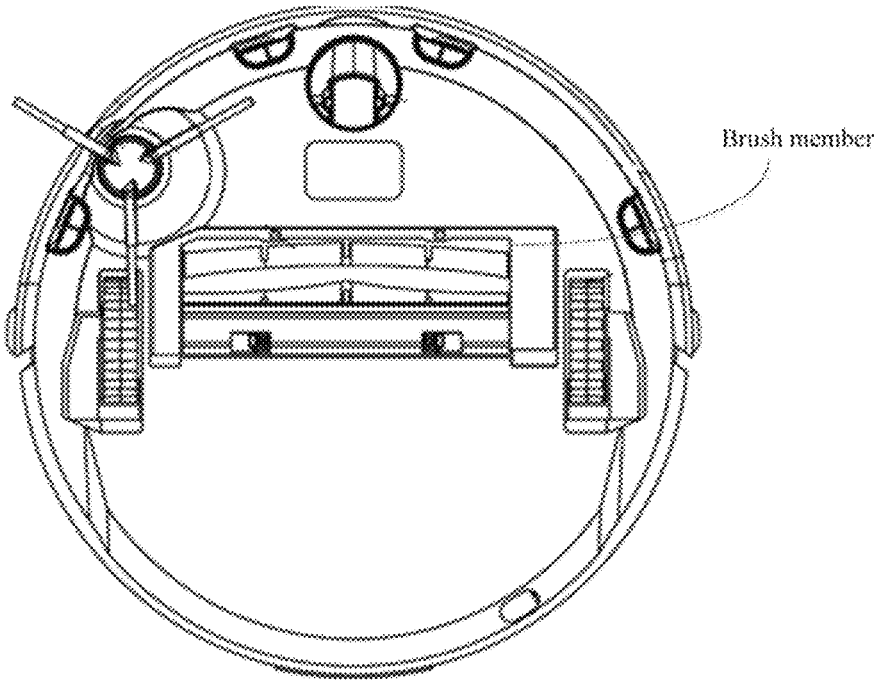
FIG. 7 is an overall schematic structural diagram of a cleaning robot according to an embodiment of the present application.

As shown in FIG. 7, an embodiment of the present application provides a cleaning robot, including a driving part 5 and the brush member in Embodiment 1 and Embodiment 2. The structures of the brush and the brush member have been described above, and details are not described herein again.

Figure 8:
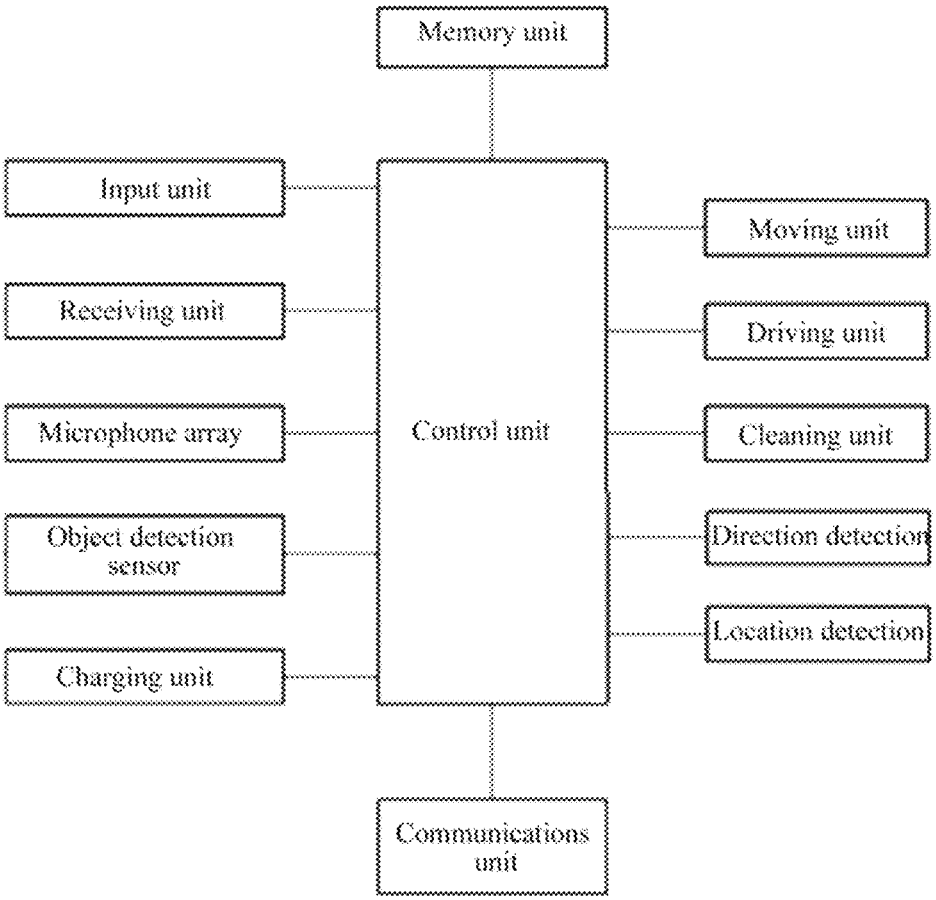
FIG. 8 is an overall structural block diagram of a cleaning robot according to an embodiment of the present application.

As shown in FIG. 8, the robot includes a machine body, a perception system, a control unit, a driving unit, a cleaning unit, an energy system, and a man-machine interaction system, and so on. The cleaning unit may be a dry-cleaning system and/or a wet-cleaning system. The main cleaning function of the dry-cleaning system is derived from a sweeping system that includes a brush mentioned in the above embodiments, a dust box, a vacuum, an air outlet, and connecting parts between the four parts. The brush that has interference with the floor sweeps debris on the floor and agitates the debris to the front of a dust suction port between the brush and the dust box, and then the debris is sucked into the dust box by airflow that is generated by the vacuum and that has suction force and passes through the dust box. The dust removal ability of the sweeping robot may be represented by dust pick-up efficiency (DPU). The DPU is affected by the brush structure and a material thereof, by wind power utilization of an air duct including the dust suction port, the dust box, the vacuum, the air outlet, and the connecting parts between the four parts, and by the type and power of the vacuum, and, therefore, there is a complex system design problem. The increase in the dust removal ability is more significant for energy-limited cleaning robots than for conventional plug-in cleaners. A higher dust-removal ability directly and effectively reduces the energy requirement; in other words, a machine that can clean 80 square meters of the floor previously after being charged once can be evolved to clean 100 or more square meters of the floor after being charged once.

Moreover, as charging times decrease, the service life of a battery increases greatly, so that the frequency of replacing the battery by the user decreases. More intuitively and importantly, the higher dust-removal ability is the most visible and important user experience, because it allows the user to directly determine whether the floor is swept/wiped clean. The dry-cleaning system may further include a side brush having a rotating shaft. The rotating shaft is located at an angle relative to the floor, so as to move debris into a region of the rolling brush of the cleaning system.

According to the cleaning robot provided in the embodiments of the present application, the addition of a detachable baffle can effectively prevent filaments on the brush of the cleaning robot from entering the motor, and the design of the foolproof structure can effectively prevent a user from missing a detachable baffle, and further prevent filament and other objects from entering the driving motor of the main brush, thereby preventing damage to the motor.

The foregoing solutions in the embodiments of the present application have at least the following beneficial effects. According to the brush, the brush member, and the robot provided in the embodiments of the present application, the addition of a detachable baffle can effectively prevent hair on the brush of the cleaning robot from entering the motor, and the ingenious design of the anti-missing mounting structure can effectively prevent a user from missing a detachable baffle, and further prevent hair and other objects from entering the driving motor of the main brush, thereby preventing damage to the motor.

The described apparatus embodiments are merely examples. The units described as separate parts may or may not be physically separate, and parts displayed as units may or may not be physical units, may be located in one position, or may be distributed on a plurality of network units. Some or all the modules may be selected according to actual needs to achieve the objectives of the solutions of the embodiments.

Finally, it should be noted that the foregoing embodiments are merely intended for describing the technical solutions in some embodiments of the present application, but not for limiting the present application. Although the present application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present application.

What is claimed is:

1. A brush, applied to a cleaning robot, comprising:

a brush body, comprising:

a rotating shaft having a first end portion and a second end portion;

a compliant portion extending radially outward from the rotating shaft;

a first detachable baffle detachably mounted to the first end portion, wherein the first end portion has a first mounting portion configured to match a shape of the first detachable baffle and to be assembled with the first detachable baffle through being inserted into a hole of the first detachable baffle, and a second mounting portion configured to match a structure of a first side wall of a member housing, wherein the second mounting portion extends outward along the first mounting portion and forms a step with the first mounting portion; and a second detachable baffle detachably mounted to the second end portion, wherein the first end portion is provided with a foolproof structure, and the foolproof structure comprises a groove and at least one clamping part, the groove is disposed on the first mounting portion and the second mounting portion along an axial direction of the rotating shaft and crosses through the step between the first mounting portion and the second mounting portion, the at least one clamping part comprises a first protrusion which is located at the second mounting portion, and a second protrusion which is located at the first mounting portion and arranged on a same side as the first protrusion, and the at least one clamping part has a free end that can extend out of the groove when the at least one clamping part is in an unassembled state, and wherein the foolproof structure is configured so that the at least one clamping part is pressed by the first detachable baffle and retracts into the groove when the first detachable baffle is mounted on the first mounting portion and an inner side of the first detachable baffle abuts against the second protrusion, so as to enable the first protrusion to retract into the groove located on the second mounting portion, and the second mounting portion to extend into the first side wall of the member housing, and so that the at least one clamping part is not pressed by the first detachable baffle and extends out of the groove when the first detachable baffle is not mounted on the first mounting portion, so as to prevent the second mounting portion from extending into the first side wall of the member housing.

2. The brush according to claim 1, wherein the foolproof structure further comprises an elastic element, the elastic element and the at least one clamping part are mounted in the groove, and the at least one clamping part is configured to retract into or extend out of the groove through a connection with the elastic element.

3. The brush according to claim 2, wherein one end of the elastic element is connected to the clamping part, and another end of the elastic element abuts against a bottom of the groove.

4. The brush according to claim 2, wherein the groove is a through hole penetrating the first mounting portion and the second mounting portion;

wherein the elastic element is disposed in the groove, and two clamping parts are respectively arranged on two ends of the groove and connected to the elastic element.

5. The brush according to claim 2, wherein the first mounting portion further comprises a locking portion;

wherein an inner side of the first detachable baffle is provided with a locking block, and when the first detachable baffle is mounted on the first end portion, the locking block slides into the locking portion.

6. The brush according to claim 5, wherein the locking portion has an L-shaped sliding groove structure.

7. The brush according to claim 5, wherein the locking portion has a spherical recess structure, and the locking block has a hemispherical protrusion structure.

8. The brush according to claim 1, wherein the second mounting portion has a square structure.

9. The brush according to claim 1, wherein the first detachable baffle comprises a baffle mounting portion and a baffle portion, wherein the baffle mounting portion is an aperture having an inner diameter matching with an outer diameter of the first mounting portion;

wherein the baffle portion extends outward along a circumferential direction of the aperture.

10. The brush according to claim 9, wherein the baffle portion comprises a first guard and a second guard disposed parallel to each other to form a maze.

11. A brush member, applied to a cleaning robot, comprising a member housing and a brush, wherein the brush comprises:

a brush body, comprising:

a rotating shaft having a first end portion and a second end portion;

a compliant portion extending radially outward from the rotating shaft;

a first detachable baffle detachably mounted to the first end portion, wherein the first end portion has a first mounting portion configured to match a shape of the first detachable baffle and to be assembled with the first detachable baffle through being inserted into a hole of the first detachable baffle, and a second mounting portion configured to match a structure of a first side wall of the member housing, wherein the second mounting portion extends outward along the first mounting portion and forms a step with the first mounting portion; and a second detachable baffle detachably mounted to the second end portion, wherein the first end portion is further provided with a foolproof structure, and the foolproof structure comprises a groove and at least one clamping part, the groove is disposed on the first mounting portion and the second mounting portion along an axial direction of the rotating shaft and crosses through the step between the first mounting portion and the second mounting portion, the at least one clamping part comprises a first protrusion which is located at the second mounting portion, and a second protrusion which is located at the first mounting portion and arranged on a same side as the first protrusion, and the at least one clamping part has a free end that can extend out of the groove when the at least one clamping part is in an unassembled state, and wherein the foolproof structure is configured so that the at least one clamping part is pressed by the first detachable baffle and retracts into the groove when the first detachable baffle is mounted on the first mounting portion and an inner side of the first detachable baffle abuts against the second protrusion, so as to enable the first protrusion to retract into the groove located on the second mounting portion, and the second mounting portion to extend into the first side wall of the member housing, and so that the at least one clamping part is not pressed by the first detachable baffle and extends out of the groove when the first detachable baffle is not mounted on the first mounting portion, so as to prevent the second mounting portion from extending into the first side wall of the member housing.

12. The brush member according to claim 11, wherein the member housing comprises the first side wall and a second side wall, wherein the second side wall is configured to connect to the second end portion, and the first side wall is configured to connect to the first end portion and comprises a first accommodation hole and a first annular groove, and wherein the first accommodation hole is configured to accommodate the first end portion, and the first annular groove is configured to accommodate the first detachable baffle.

13. The brush member according to claim 11, wherein the foolproof structure of the first end portion further comprises an elastic element, the elastic element and the at least one clamping part are mounted in the groove, and the at least one clamping part is configured to retract into or extend out of the groove through a connection with the elastic element.

14. The brush according to claim 13, wherein one end of the elastic element is connected to the clamping part, and another end of the elastic element abuts against a bottom of the groove.

15. The brush member according to claim 13, wherein the groove is a through hole penetrating the first mounting portion and the second mounting portion;

wherein the elastic element is disposed in the groove, and two clamping parts are respectively arranged on two ends of the groove and connected to the elastic element.

16. A cleaning robot, comprising a brush member having a member housing and a brush, wherein the brush comprises:

a brush body, comprising:

a rotating shaft having a first end portion and a second end portion;

a compliant portion extending radially outward from the rotating shaft;

a first detachable baffle detachably mounted to the first end portion, wherein the first end portion has a first mounting portion configured to match a shape of the first detachable baffle and to be assembled with the first detachable baffle through being inserted into a hole of the first detachable baffle, and a second mounting portion configured to match a structure of a first side wall of the member housing, wherein the second mounting portion extends outward along the first mounting portion and forms a step with the first mounting portion; and a second detachable baffle detachably mounted to the second end portion, wherein the first end portion is further provided with a foolproof structure, and the foolproof structure comprises a groove and at least one clamping part, the groove is disposed on the first mounting portion and the second mounting portion along an axial direction of the rotating shaft and crosses through the step between the first mounting portion and the second mounting portion, the at least one clamping part comprises a first protrusion which is located at the second mounting portion, and a second protrusion which is located at the first mounting portion and arranged on a same side as the first protrusion, and the at least one clamping part has a free end that can extend out of the groove when the at least one clamping part is in an unassembled state, and wherein the foolproof structure is configured so that the at least one clamping part is pressed by the first detachable baffle and retracts into the groove when the first detachable baffle is mounted on the first mounting portion and an inner side of the first detachable baffle abuts against the second protrusion, so as to enable the first protrusion to retract into the groove located on the second mounting portion, and the second mounting portion to extend into the first side wall of the member housing, and so that the at least one clamping part is not pressed by the first detachable baffle and extends out of the groove when the first detachable baffle is not mounted on the first mounting portion, so as to prevent the second mounting portion from extending into the first side wall of the member housing.

* * * * *